United States Patent [19]

Dickenson

[11] 4,357,803

[45] Nov. 9, 1982

[54] CONTROL SYSTEM FOR BYPASS STEAM TURBINES

[75] Inventor: Royston J. Dickenson, Scotia, N.Y.

[73] Assignee: General Electric Company, Schenectady, N.Y.

[21] Appl. No.: 184,359

[22] Filed: Sep. 5, 1980

[51] Int. Cl.[3] ..... F01K 13/02

[52] U.S. Cl. ..... 60/662; 60/663; 60/667; 60/679

[58] Field of Search ..... 60/660, 662, 663, 664, 60/665, 667, 677, 679

[56] References Cited

U.S. PATENT DOCUMENTS

| | | | |
|---|---|---|---|
| 3,097,488 | 7/1963 | Eggenberger et al. | 60/660 |
| 3,488,961 | 1/1970 | Gerber | 60/664 |
| 3,699,681 | 10/1972 | Frutschi | 60/682 |
| 3,919,846 | 11/1975 | Lecocq | 60/657 |
| 3,928,972 | 12/1975 | Osborne | 60/646 |
| 4,118,935 | 10/1975 | Andersson | 60/662 |
| 4,132,076 | 1/1979 | Weiss | 60/646 |
| 4,201,924 | 5/1980 | Uram | 290/40 R |

OTHER PUBLICATIONS

Vol. 35, *Proceedings of the American Power Conference,* "Bypass Stations for Better Coordination Between Steam Turbine and Steam Generator Operation," P. Martin et al.

*Primary Examiner*—Allen M. Ostrager

*Attorney, Agent, or Firm*—Ormand R. Austin; John F. Ahern

[57] ABSTRACT

A control system for a steam turbine operated with a steam bypass system. In the control system, bypass valve control is according to setpoints generated as a function of a combined flow reference (CFR) signal. The CFR signal is representative of boiler outlet flow under all turbine operating phases and is generated by multiplying the sum of the steam admission control valve flow demand and the high pressure bypass flow demand by boiler pressure. An actual load demand (ALD) signal indicative of the turbine demand for steam is produced from the product of the steam admission control valve flow demand and boiler pressure, and is used for intercept valve control. Excessive steam flow in the lower pressure bypass subsystem is prevented by providing an override for the normal control to prevent high heat impact to the condenser and latter stages of the turbine high pressure section.

18 Claims, 5 Drawing Figures

CONTROL SYSTEM FOR BYPASS STEAM TURBINES

This invention pertains to automatic control systems for steam turbines and more particularly to automatic control systems for steam turbines having a steam bypass mode.

BACKGROUND OF THE INVENTION

Large steam turbines of the type used by the utility companies for producing electrical power may be advantageously operated with a steam bypass system to divert excess steam from the turbine to pass directly to the condenser under certain operating conditions. The bypass mode of operation permits the steam generator to be maintained at a high steam production rate and pressure regardless of the load demand on the turbine as excess steam is bypassed during periods of low turbine loading. As load on the turbine is increased, more steam flow can be apportioned to it and less bypassed until a point is reached at which all of the steam is devoted to the turbine and none bypassed. Once the bypass is completely shut off, coordinated boiler control maintains a desired pressure-flow characteristic and increased turbine demand for steam may, for example be satisfied by allowing the boiler pressure to increase, or slide upward, in support of the increasing load. As load on the turbine is lessened, the boiler pressure may then be allowed to decrease to some acceptable minimum level as excess steam is again bypassed around the turbine.

The principal advantages of this mode of operation are believed to be:

(1) shorter turbine startup times;
(2) use of larger turbines for cycling duty for quicker responses to changes in load;
(3) avoidance of boiler tripout with sudden loss of load;
(4) reduction of solid particle erosion;
(5) enables the boiler to be operated independently of the turbine; and
(6) allows the boiler to be more stably operated with better matching of steam to turbine metal temperatures.

A general discussion of the sliding pressure, or bypass mode of operation appears in Vol. 35, *Proceedings of the American Power Conference,* "Bypass Stations For Better Coordination Between Steam Turbine and Steam Generator Operation", by Peter Martin and Ludwig Holly.

Contrasted with the more conventional mode of turbine operation (wherein the boiler generates only enough steam for immediate use and where there are no bypass paths), the bypass mode of turbine operation necessitates unified control of a more complex valving arrangement. The control system must provide precise coordination and control of the various valves in the steam flow paths and do so under all operating conditions while maintaining appropriate load and speed control of the turbine.

Various control systems have been developed for reheat steam turbines operating in the bypass mode. In one known scheme, pressure in the first stage of the turbine is used as an indicator signal of steam flow from which reference set points are generated for control of the high pressure and low pressure bypass valves. There are no provisions in this scheme, however, for directly coordinating operation of the bypass valves with operation of the main control valve which must be responsive to speed and load requirements, nor are there provisions for coordinated operation with other valves of the system. Furthermore, it is recognized that first stage pressure is not a valid indicator of steam flow under all prevailing conditions.

In another known control system for bypass steam turbines, a flow measuring orifice in the main steam line provides a signal indicative of total steam flow which forms the basis for a pressure reference signal for control of the high pressure and low pressure bypass valves. The principal disadvantage of this system is that the flow measurement requires an intrusion into the steam flow path which causes a pressure drop and loss in heat rate.

In U.S. patent application Ser. No. 046,865, now U.S. Pat. No. 4,253,308 assigned to the assignee of the instant invention, Eggenberger et al discloses and claims a comprehensive control system for a steam turbine and bypass system which is much improved over the prior art and in which an actual load demand (ALD) signal is generated to produce independent pressure reference functions for control of boiler and reheat pressure. The ALD signal is a measure of actual steam flow to the turbine and is obtained by taking the product of boiler pressure and an admission control valve positioning signal generated by the speed and load control loop. The ALD signal provides an accurate measure of steam flow without the necessity of having a flow sensor installed in the steam line with the attendant pressure drop and loss in heat rate. Furthermore, in contrast to indirect methods of steam flow measurement such as sensing turbine first stage pressure, the ALD signal is a valid indicator of steam flow to the turbine under all operating conditions. The disclosure of the above-mentioned U.S. Pat. No. 4,253,308 is hereby incorporated herein by reference.

Viewed strictly as a control system for a steam turbine and bypass system operating over a narrow range of boiler steam flow conditions, the above-mentioned control system of Eggenberger materially advances the art of turbine bypass control systems. However, with the bypass mode of operation being extended to ever larger turbines operating over a wider range of flow conditions and with the requirement that the bypass system be capable of handling the entire steam supply, it becomes imperative that the turbine and bypass system be controlled so that the boiler is not subjected to widely varying steam flow rates that produce large fluctuations in boiler pressure. It is particularly important that the boiler be immunized from the effects of turbine transient conditions such as a sudden turbine trip. Prior art control systems have not adequately dealt with these problems without some sacrificing in heat rate.

Additionally, and particularly with larger turbines, the steam condenser and last stages of the high pressure section of the turbine are subject to high temperature effects under certain operating conditions associated with the bypass mode of operation. One aspect of the problem of high temperatures in the last stages of the high pressure section (known as "windage loss heating"), is dealt with by a reverse steam flow system disclosed and claimed in copending application Ser. No. 105,019, now U.S. Pat. No. 4,309,873, which is of common assignee with the instant application, and whose disclosure is hereby incorporated herein by reference. To fully protect both the condenser and the last stages of the high pressure section, however, rational limitations must still be imposed on the steam flow which passes through the bypass system around the lower pressure sections of the turbine. Although such limitations are required, they should not interfer with turbine control but should guard against potential overheating in the condenser and last stages of the high pressure section of the turbine such as may occur with excessively high rates of steam flow by passing lower pressure sections of the turbine.

Accordingly, it is the general objective of the present invention to provide a control system for a reheat steam turbine and its associated bypass system in solution to the problems outlined above. More specifically, it is sought to provide a system for precise and comprehensive control of a bypass steam turbine so that boiler pressure and steam flow may remain substantially free from the effects of transient turbine operating conditions.

Another specific objective of the present invention is to provide a control system for a bypass steam turbine which turbine includes means for reverse steam flow through the high pressure turbine section to prevent windage loss heating.

A still further objective of the invention is to provide a turbine control system having means to control the steam flow bypassing lower pressure sections of the turbine so that overheating of the condenser and latter stages of the high pressure turbine section due to excessive steam flow rates is prevented.

SUMMARY OF THE INVENTION

These and other objectives are attained in an automatic control system for a steam turbine by providing a combined flow reference (CFR) signal from which first and second independent pressure reference functions are generated to serve as control points, or set points, according to which the boiler pressure and reheater pressure are controlled by regulating, respectively, a flow control valve or valves in a high pressure (HP) bypass subsystem and a flow control valve or valves in a lower pressure (LP) bypass subsystem. The CFR signal is formed from the sum of the products of (1) boiler pressure and a signal representative of the degree of opening of steam admission control valves, and (2) boiler pressure and a signal representative of the degree of opening of the flow control valve in the high pressure bypass subsystem. The CFR signal therefore represents the total instantaneous steam flow from the boiler.

An actual load demand (ALD) signal indicative of the turbine demand for steam is produced from the product of a turbine demand signal and boiler pressure. The turbine demand signal is derived from a load and speed control loop. The intercept valve controlling the flow of steam to the lower pressure sections of the turbine is positioned according to the magnitude of the ALD signal and inversely to the magnitude of the reheat pressure.

Thus the overall control system comprises a control loop for turbine speed and load; a control loop for a high pressure bypass subsystem; a control loop for a low pressure bypass subsystem; and a control loop for the intercept valves. Means are provided for overriding the lower pressure bypass control loop, normally regulating reheater steam pressure, to prevent excessive steam flow in the lower pressure (LP) bypass subsystem.

BRIEF DESCRIPTION OF THE DRAWING

While the specification concludes with claims particularly pointing out and distinctly claiming the subject matter regarded as the invention, the invention will be better understood from the following description taken in connection with the accompanying drawings in which;

DETAILED DESCRIPTION OF THE INVENTION

Figure 1:
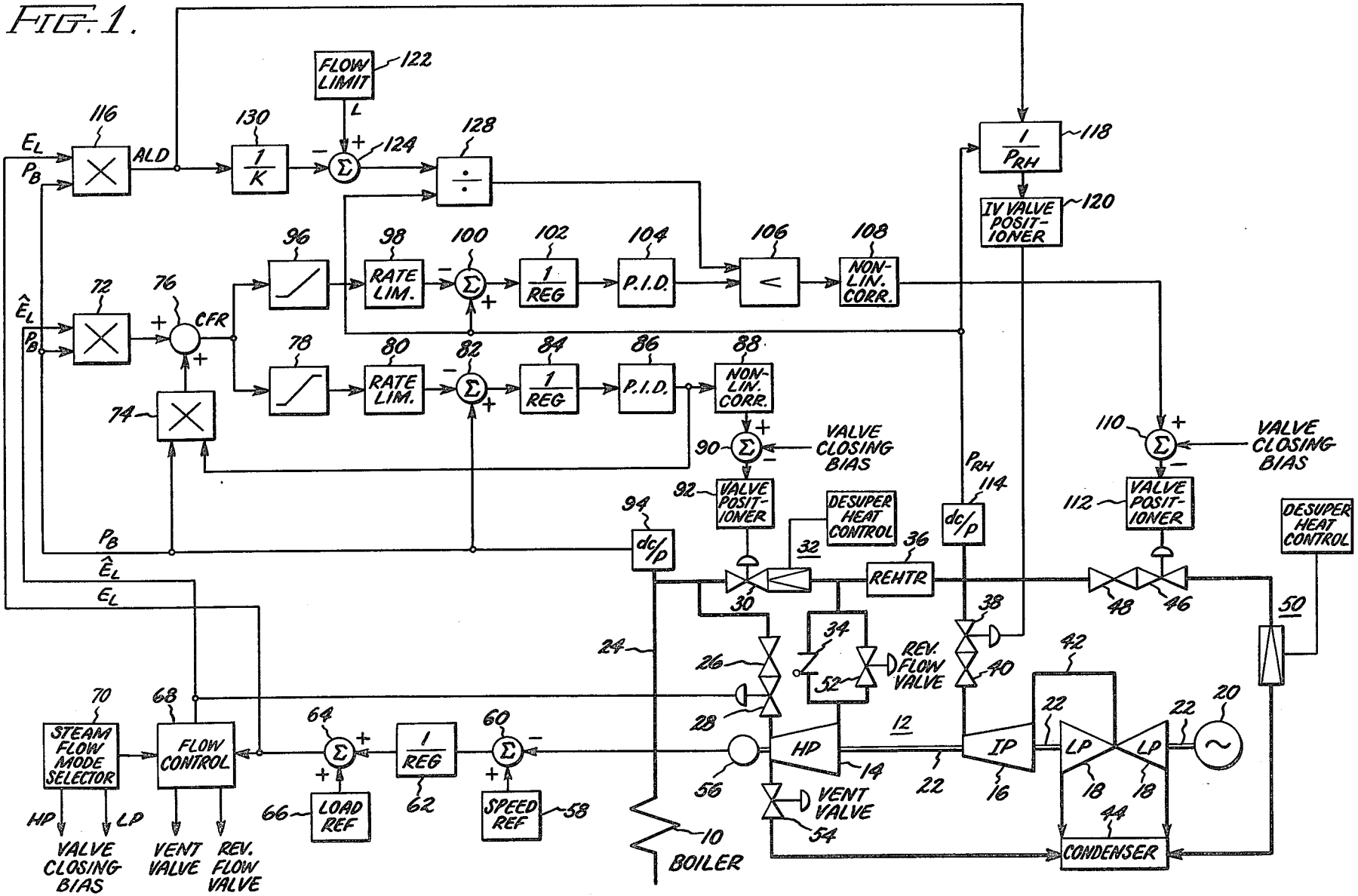
FIG. 1 schematically illustrates, in block diagram format, a preferred embodiment of the turbine control system according to the present invention.

In the electrical power generating plant of FIG. 1, a boiler 10 serves as the source of high pressure steam, providing the motive fluid to drive a reheat steam turbine 12 which includes high pressure (HP) section 14, intermediate pressure (IP) section 16, and low pressure (LP) section 18. Although this is conventional nomenclature, at times herein the IP section 16 and LP section 18 may be grouped together and referred to as the lower pressure (LP) sections of the turbine. In like manner, the bypass subsystem (described herein below) which passes steam around these sections may be referred to as the lower pressure or LP bypass subsystem. Although the turbine sections 14, 16, and 18 are illustrated to be tandemly coupled to generator 20 by a shaft 22, other coupling arrangements may be utilized.

The steam flow path from boiler 10 is through steam conduit 24, from which steam may be taken to HP turbine 14 through main stop valve 26 and admission control valve 28. A high pressure bypass subsystem including HP bypass valve 30 and desuperheating station 32 provides an alternative or supplemental steam path around HP section 14. It will be recognized that, although one HP bypass subsystem is illustrated, other parallel bypass paths, each including a flow control valve, may also be utilized. In any case, steam flow exhausting from HP turbine 14 passes through check valve 34 to rejoin any bypassed steam and the total flow then passes through reheater 36. From reheater 36, steam may be taken through the intercept valve 38 and reheater stop valve 40 to the IP turbine 16 and LP turbine 18 which are series connected in the steam path by conduit 42. Steam exhausted from the LP turbine 18 flows to condenser 44. A lower pressure (LP) bypass subsystem including LP bypass valve 46, LP bypass stop valve 48, and desuperheating station 50 provides an alternative or supplemental steam path around IP turbine 16 and LP turbine 18 to condenser 44.

Associated with the HP section 14, and principally used for no-load and low-load operating conditions, are reverse flow valve 52 and ventilator valve 54. These valves, 52 and 54, are used to provide a reverse flow of steam through the HP turbine in the manner disclosed and claimed in the above-cited U.S. Pat. No. 4,309,873. It is sufficient to note here that the reverse steam flow eliminates rotation loss (windage loss) heating which occurs under certain low-load conditions of the type associated with the bypass mode of operation. Thus the reverse flow pattern is used mostly for turbine startup during which forward flow of steam through IP section 16 and LP section 18 is used to drive the turbine as steam admission control vavle 28 is held closed. Although the admission control valve 28 is referred to herein as a single valve for the purpose of explaining the invenion, in actual practice, as is well known, a plurality of control valves are used in a circumferential arrangement upon nozzle arcs to achieve either full or partial arc admission of steam to the turbine 12.

A speed and load control loop, operative to control the flow of steam to the turbine sections 14, 16, and 18 so as to maintain preset values of turbine speed and load, includes speed transducer 56 to provide a signal indicative of actual turbine speed; a speed reference unit 58 by which the desired speed is selected; a speed summing junction 60 which comprises the turbine actual speed with the desired speed and supplies an error signal indicative of the difference; an amplifying means 62 having gain inversely porportional to the desired degree of speed regulation; a load summing junction 64 to sum the amplified speed error signal with the desired load setting supplied by load reference unit 66; and a flow control unit 68. The speed and load control loop interacts with a flow mode selector 70 which provides for optionally switching the HP and LP bypass subsystems out of operation and keeping HP bypass valve 30 and LP bypass valve 46 closed allowing turbine 12 to be operated conventionally. The speed and load control loop of the system is substantially the same as was disclosed in U.S. Pat. No. 3,097,488 to Eggenberger, the disclosure of which is incorporated herein by reference thereto.

Flow control unit 68 provides a signal to position control valve 28 to admit more or less steam to the HP turbine 14 and may also include means to linearize the flow characteristics of control valve 28. Depending upon the operating phase of the turbine 12, i.e., whether the turbine is being started up, is under low-load, or full load, etc., flow control unit 68 also provides signals to open or close reverse flow valve 52 and ventilator valve 54. Although the criteria according to which valves 52 and 54 are operated are not material to the present invention, these valves are illustrated and their operative functions described to illustrate the present invention's utility in connection with a turbine which may either have or not have reverse steam flow valving.

The speed and load control loop is the source of signals $E_L$ and $\hat{E}_L$ used in the other control loops, namely in the HP and LP bypass control loops and in the intercept valve control loop. The signals $E_L$ and $\hat{E}_L$ are referred to herein, respectively, as the turbine demand signal and the admission control valve positioning signal. The turbine demand signal $E_L$ is indicative of the turbine demand for steam due to load requirements and speed error regardless of whether the turbine 12 is under load with forward flow of steam through HP section 14 or whether there is a reverse flow of steam in HP section 14 with control valve 28 closed and the turbine 12 being driven solely by the steam passing to IP section 16 and LP section 18. On the other hand, the admission control valve position signal $\hat{E}_L$ is indicative of the degree to which control valve 28 is opened or closed. It will be recognized, therefore, that $E_L$ and $\hat{E}_L$ convey identical information when turbine 12 is in the forward steam flow regime, i.e., control valve 28 is opened to some degree and reverse flow valve 52 and ventilator valve 54 are closed. However, under reverse flow conditions wherein control valve 28 is closed and valves 52 and 54 are opened, $E_L$ and $\hat{E}_L$ are not identical and, in fact, $\hat{E}_L$ is equal to zero to cause valve 28 to be closed. The $E_L$ and $\hat{E}_L$ signals are utilized in the HP and LP bypass control loops and in the intercept valve control loop, each of which is more fully described herein below.

Control of the HP bypass valve 30 and of the LP bypass valve 46 is determined by a combined flow reference (CFR) signal indicative of total steam flow from the boiler 10. The CFR signal is formed by summing the products of (1) boiler pressure (designated $P_B$) and $\hat{E}_L$, and (2) boiler pressure $P_B$ and a signal indicative of the degree of opening of the HP bypass valve. Multiplier 72 provides the first product; multiplier 74 provides the second product; and the output of CFR summing junction 76 provides the sum of these products.

The CFR signal is applied to an HP bypass control loop including HP function generator 78; HP rate limiter 80; HP summing junction 82; HP regulation amplifier 84; proportional-integral-derivative (PID) controller 86; HP nonlinearity corrector 88; HP closing bias summing junction 90; and HP valve positioner 92. Function generator 78 provides a reference signal, or set point, $P_{REF\,HP}$, whose value is a function of the CFR signal and against which the boiler pressure is compared in HP summing junction 82 to produce an HP error signal output (assuming no effect from rate limiter 80 which will be more fully described herein below). Boiler pressure signal $P_B$ is provided by boiler pressure transducer 94. The error signal from summer 82, representing the difference between the reference value of pressure and the actual boiler pressure, is minimized by the action of the PID controller 86 through its throttling action on HP bypass valve 30. The output of the PID controller 86 is indicative of the degree of opening of the HP bypass valve 30 and, accordingly, is taken as one input to multiplier 74 as was mentioned above to form the CFR signal. The output of the PID controller 86 may also be referred to herein as the HP bypass valve position signal.

Figure 2:
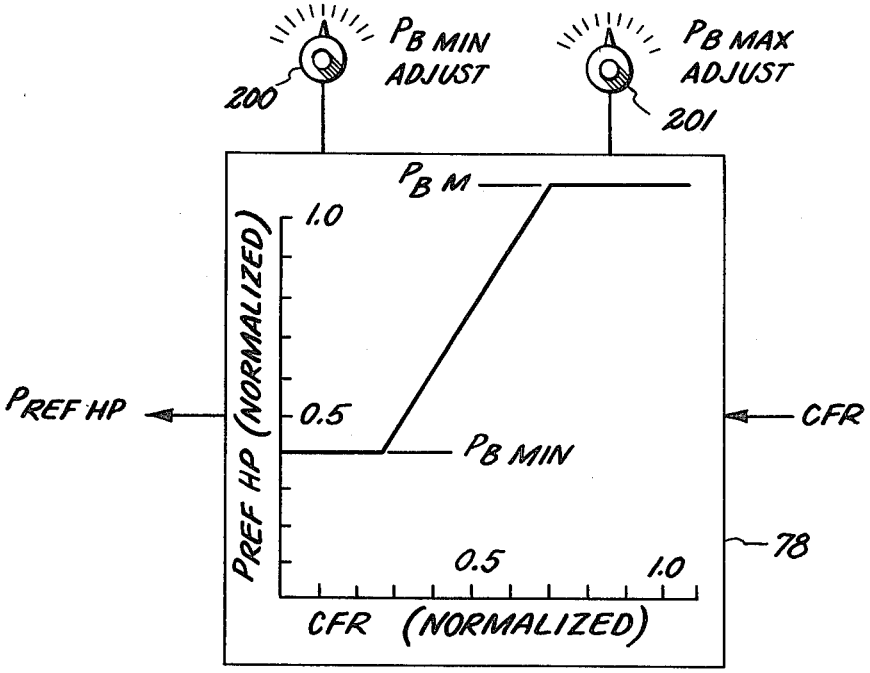
FIG. 2 is an example of the high pressure reference signal ($P_{REF\ HP}$), generated as a function of the combined flow reference signal.

An example of the function produced by $P_{REF\,HP}$ function generator 78 is shown in FIG. 2 wherein $P_{REF\,HP}$ is a function of the CFR signal. In the example shown, $P_{REF\,HP}$ at low values of CFR is a constant equal to a minimum selected boiler pressure $P_{B\,MIN}$, and is ramped upward to a second constant value $P_{B\,MAX}$, selected to be just greater than the rated boiler pressure, with higher values of CFR. Function generator 78 includes adjustments 200 and 201 (illustrated in FIG. 2) provided, respectively, to select $P_{B\,MIN}$ and $P_{B\,MAX}$. The slope of the ramped portion of the function $P_{REF\,HP}$ is preselected depending on boiler characteristics. Function generators operative as described, and as will hereinafter be described in conjunction with the LP bypass control loop, are well known in the art and may generally be of the type described in U.S. Pat. No. 3,097,488.

Rate limiter 80 prevents $P_{REF\ HP}$ from increasing or decreasing at an excessive rate with a sudden change of CFR. For example, a sudden drop in CFR may momentarily occur with a sudden loss of load. In such case, rate limiter 80 prevents the occurrence of a large error signal which would tend to rapidly swing the bypass valve 30 from closed to opened, causing shock to the boiler 10 from the quick release of steam pressure. PID controller 86 and HP regulation amplifier 84 accept the error signal from HP summing device 82 to produce a signal proportional to the error and its time interval and rate of change so as to position HP bypass valve 30 accordingly. Non-linearity corrector 88 may be of the type well known in the art to provide a linear relationship between the operative control signal for bypass valve 30 and the steam flow therethrough. Summing junction 90 accepts a valve closing bias signal from steam flow mode selector 70 whereby under an operator's direction or in the event of a bypass valve trip condition, valve 30 and the high pressure bypass subsystem can be closed to steam flow. In the bypass mode of operation, no valve closing bias is applied to junction 90 and the signal from non-linearity corrector 88 determines the position of the HP bypass valve 30. Valve positioner 92 may be electrohydraulic valve positioning apparatus of the type disclosed in U.S. Pat. No. 3,403,892, the disclosure of which is incorporated herein by reference.

Figure 3:
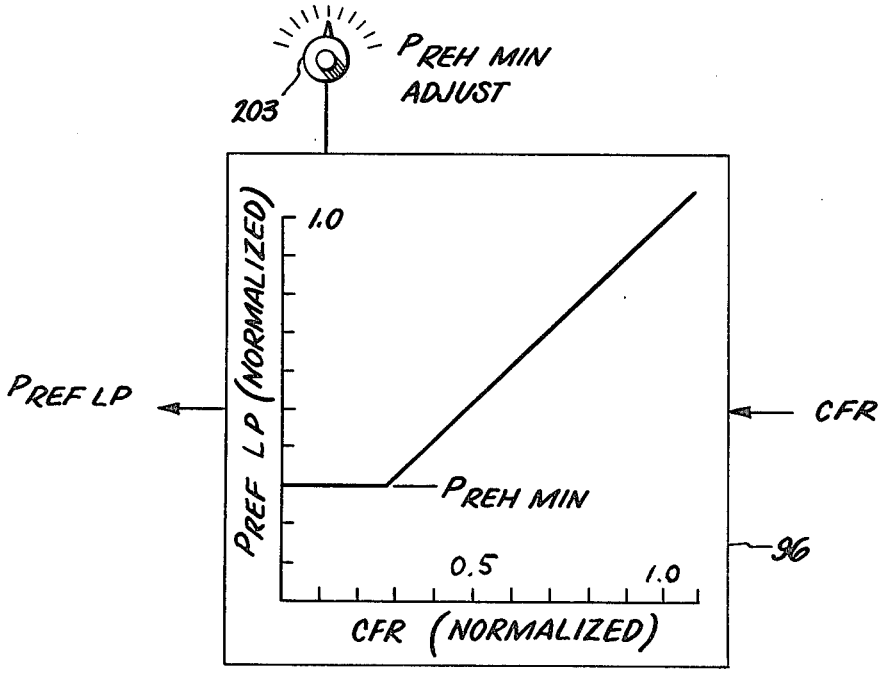
FIG. 3 is an example of the low pressure reference signal ($P_{REF\ LP}$), generated as a function of the combined flow reference signal.

The CFR signal, indicative of total steam flow from boiler 10, is also applied to an LP bypass control loop including $P_{REF\ LP}$ function generator 96; LP rate limiter 98; LP summing junction 100; LP regulation amplifier 102; PID controller 104; low value gate 106; LP non-linearity corrector 108; closing bias summing junction 110; and LP valve positioner 112. In the LP bypass control loop, LP function generator 96 provides a reference pressure signal, or set point, $P_{REF\ LP}$ based on the value of the CFR signal, for example, as shown in FIG. 3. The function $P_{REF\ LP}$ is a constant at lower values of CFR, representing the minimum allowable reheat pressure $P_{REH\ MIN}$, then is ramped upward as the CFR value increases. The $P_{REF\ LP}$ function generator 96 is provided with adjustment 203 (shown in FIG. 3) to select the desired value of $P_{REH\ MIN}$, which is determined by the operating parameters of the reheater boiler 36 and of HP section 14. The time rate of change of $P_{REF\ LP}$ is limited by rate limiter 98 so that, with rapid changes in CFR, the $P_{REF\ LP}$ value is not allowed to change faster than a preselected rate. The LP rate limiter 98 thus prevents excessively fast operation of LP bypass valve 46 and damps pressure transients in reheater 36.

In the LP bypass control loop the $P_{REF\ LP}$ value is compared with actual reheater pressure $P_{RH}$, as measured by pressure transducer 114. Summing junction 100 provides the comparison, producing an LP error signal whose magnitude and polarity depend on the difference between the desired value of reheater pressure $P_{REF\ LP}$ and the existing reheater pressure $P_{RH}$. The error signal is applied to LP regulation amplifier 102 and PID controller 104, which, as are regulation amplifier 84 and PID controller 86 of the HP bypass control loop, well known elements of control systems which provide corrective action in a feedback control loop. In the LP bypass loop of FIG. 1, the output of PID controller 104 applies corrective action to LP bypass valve 46 through low value gate 106 (more fully described herein below), non-linearity corrector 108, summing junction 110, and valve positioner 112. Non-linearity corrector 108 compensates for any inherent non-linear relationship between the actuation signal for LP bypass valve 46 and the flow of steam therein. Valve positioner 112 is preferably an electrohydraulic positioner as described above for use in the HP bypass control loop. A valve closing bias to force the LP bypass valve closed under certain operating conditions is added through summing junction 110.

A signal indicative of turbine actual load demand (ALD) is formed by the product of turbine demand $E_L$ and boiler pressure $P_B$ in ALD multiplier 116. The ALD signal is a controlling signal for the intercept valve control loop which includes amplifier 118 and intercept valve positioner 120. The intercept control loop provides for throttling the intercept valve at reduced load to maintain the minimum allowable reheater pressure $P_{REH\ MIN}$ and, during operation under reverse steam flow in the HP section 14, provides load and speed control by admitting more or less steam to IP section 16 and LP section 18 for driving the turbine 12. The ALD signal is passed through amplifier 118 (whose gain is automatically and continuously set to be inversely proportional to $P_{RH}$) and then to intercept valve positioner 120 which provides a proportional power signal for operation of intercept valve 38. Maintaining the gain of amplifier 118 to be inversely proportional to the reheater pressure insures that the intercept valve 38 is throttling over an appropriate range in magnitude of the ALD signal, that it is fully opened at higher magnitudes of the ALD signal, and that it is more responsive as the turbine sheds load.

Figure 4:
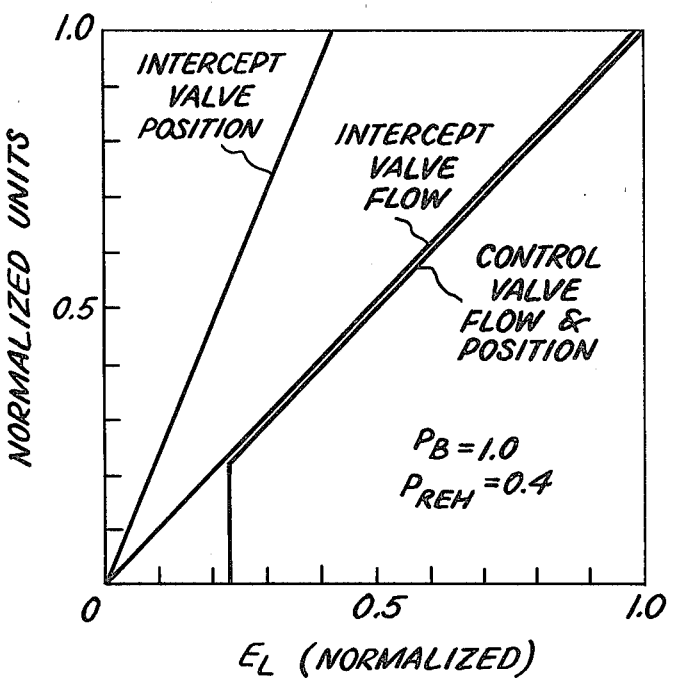
FIG. 4 graphically illustrates the relationship between admission control valve steam flow, the admission control valve position signal, intercept valve steam flow and intercept valve position signal with changes in load, all as functions of the turbine demand signal and at constant boiler pressure.
Figure 5:
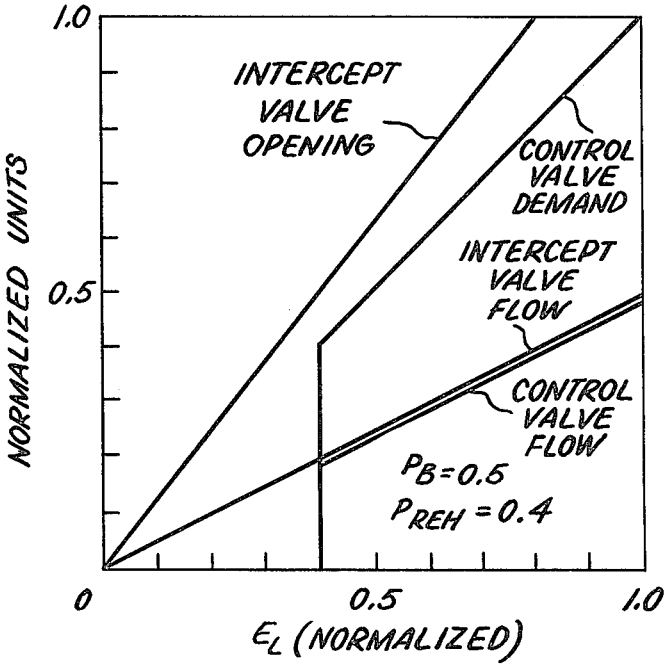
FIG. 5 is a graphic illustration similar to FIG. 4 showing the coordination of control between the intercept valve and the admission control valve to maintain a minimum reheater pressure at lower loads, and, taken with FIG. 4, illustrates that valve coordination is independent of boiler pressure.

The coordinated operation of control valve 28 and intercept valve 38 is illustrated graphically in FIGS. 4 and 5 which show the result obtained with different boiler pressures. Flow through control valve 28 is plotted in FIGS. 4 and 5 to reflect the fact that the control valve is held closed by $\hat{E}_L$ when the reverse steam flow regime is used for startup or for low-load conditions. Thus at low values of $E_L$, control valve flow and position are indicated as being zero but rising quickly to a controlled level as forward flow through HP turbine 14 is permitted. For example, in FIG. 4 forward flow occurs at $E_L$ equal to 0.2, while in FIG. 5 forward flow occurs at $E_L$ equal to 0.4. The plots of FIGS. 4 and 5 are in normalized units covering a range of 0 to 1.0 representing generally, 0 to 100% of the possible span of a particular variable. For example, a boiler pressure $P_B$ stated to be 0.5 units may be taken as a boiler pressure of 50% of rated pressure. Thus in referring to the plot of intercept valve opening as shown in FIGS. 4 and 5, a normalized value of 1.0 indicates the valve as fully open, a value of 0.5 that the valve is one-half open, and so on. This permits description of the control system independent of the limiting parameters of any given system component, e.g., boiler capacity or pressure. The graphs show that the intercept valve throttles over the range of $E_L$ necessary to maintain the minimum reheater pressure in accord with ALD and the reheat pressure.

With reference again to FIG. 1, and in particular to the LP bypass control loop, low value gate 106 is provided with two input signals of which the lowest in magnitude is automatically selected as the output. Thus the signal according to which the LP bypass valve 46 is controlled is limited to the lowest value input signal to low value gate 106. The effect of low value gate 106 is to limit the flow demand to the LP bypass valve 46. This in turn limits the flow of steam to the condenser 44 since the total flow through the intercept valve 38 and the LP bypass valve 46 is limited.

The flow demand to the LP bypass valve 46 is limited to the minimum of:

(a) normal pressure control, i.e., the signal from PID controller 104; or (b) a preselected flow limit L reduced by an amount proportional to the ratio of turbine actual load demand ALD and a constant K whose value represents the relative heat load impact on the condenser and desuperheater of steam flow through the turbine as compared to the same amount of steam flow through the LP bypass subsystem.

The normal pressure control signal of item (a) has been described above. Item (b) represents a maximum allowable steam flow through LP bypass subsystem and lower pressure sections of the turbine and serves to limit steam flow and minimize high temperature impact to the condenser and latter stages of the HP section 14. To generate this second flow limit, bypass flow limit 122 provides a preselected reference value L, appropriately scaled, from which the ratio of ALD to K is subtracted in bypass flow summing junction 124. The ALD to K ratio is provided by amplifier 130 having gain inversely proportional to K. The value of K is preferably chosen to represent the relative heat load impact on the condenser 44 and desuperheater 50 of a fixed quantity of steam passing through the bypass system as compared to the same quantity passing through the LP sections 16 and 18 of the turbine. For example, K may be on the order of 1.0 to 3.0. The value of L, scaled in normalized units in terms of maximum allowable condenser flow, is preferably in the range of 0.4 to 1.5.

Operation

A more comprehensive understanding of the invention will be facilitated by a description of its operation as the turbine undergoes changes in operating phases such as, for example, a startup or a turbine tripout. With the following, however, it is to be understood that a turbine-generator set and its associated equipment and controls forms a very complex and complicated system so that in explaining certain operations, some items ordinarily associated therewith are not illustrated or discussed. It is believed that this simplification will aid in understanding the principles and operation of the present invention.

Just prior to startup of the turbine, the boiler 10 is operated at some level of steam flow and pressure with all of the steam being bypassed through the bypass subsystems around turbine 12 to the condenser 44. At this point, the operator will select the minimum allowable main steam pressure and the minimum allowable reheater steam pressure. Assuming that turbine 12 has been appropriately prewarmed and preconditioned for operation, the turbine 12 is then started by setting the speed reference unit 58 and the load reference unit 66 to generate an appropriate turbine demand signal. Since the turbine is in its startup phase, to prevent windage loss heating in turbine section 14, flow control unit 68 maintains admission control valve 28 closed as the turbine is driven by steam passing to IP section 16 and LP section 18 through intercept valve 38. Flow control unit 68 also, under certain preselected conditions not material to the present invention, causes vent valve 54 and reverse flow valve 52 to be opened allowing steam to pass in the reverse flow direction through HP section 14 taking away windage losses in the manner described in the aforementioned U.S. Pat. No. 4,309,873.

Once the turbine 12 has been synchronized with the power grid connected to generator 20, the reverse flow of steam through HP section 14 may be terminated and a forward flow of steam therethrough established. The change in the steam flow regime is brought about through flow control unit 68 which, within a matter of seconds, causes reverse flow valve 52 and ventilator valve 54 to be closed and admission control valve 28 to be opened. Prior to the establishment of forward flow of steam through HP section 14, the turbine demand signal $E_L$ is provided to the intercept valve control loop making the intercept valve responsive to the turbine's speed and load requirements. Also, at that time, $\hat{E}_L$ is maintained at zero to insure that admission control valve 28 is held closed. However, with the forward flow of steam through HP section 14, $E_L$ and $\hat{E}_L$ are identical.

Although the $\hat{E}_L$ signal is zero when the turbine 12 is in the reverse flow regime, the LP and HP bypass control loops remain operative to position, respectively, LP bypass valve 46 and HP bypass valve 30. During the reverse flow regime, the output of multiplier 72 is, of course, zero since one of its input values is zero. However, error signals created at HP summing junction 82 and LP summing junction 100 cause the bypass valves 30 and 46 respectively to reach an equilibrium condition regardless of steam flow direction. Thus, even with turbine 12 in the reverse steam flow regime specifically used for turbine startups and for operation under low load conditions, the HP bypass control loop operates bypass valve 30 to maintain boiler pressure according to the pressure set point generated by $P_{REF\ HP}$ function generator 78 and the LP bypass control loop positions LP bypass valve 46 to control reheater pressure according to the pressure set point generated by $P_{REF\ LP}$ function generator 96.

Having transferred turbine 12 to the forward flow regime, load can be increased by appropriately setting load reference unit 66. Increasing the load setting causes $E_L$ and $\hat{E}_L$ to be increased and admission control valve 28 to be opened further to admit additional steam to turbine 12 to sustain the increased load. Since more steam is now being apportioned to the turbine 12, with a constant flow of steam from the boiler 10, the bypass valves 30 and 46 must be closed down proportionately. At higher loads on the turbine 12, bypass valves 30 and 46 may become completely closed as all of the steam from boiler 10 is passed to turbine 12 in support of its load and no steam is bypassed.

In the event of a sudden loss in electrical load such as might be expected should generator 20 be tripped from the power line, admission control valve 28 and intercept valve 38 are very rapidly closed to prevent overspeed damage to the turbine. It is desirable that boiler 10 be immunized from such abrupt changes in turbine operation as well as from other transient effects. When the admission control valve 28 is rapidly closed, $\hat{E}_L$ becomes zero and boiler pressure $P_B$, without further control action, tends to increase. However, the high pressure bypass control loop, recognizing any substantial increase in $P_B$ through summing junction 82, controls the pressure according to $P_{REF\ HP}$ by opening HP bypass valve 30 to increase the steam flow through the HP bypass subsystem. Although the CFR signal may rapidly change as a result of the quick fall of $\hat{E}_L$ to zero, rate limiter 80 prevents rapid changes in the value of $P_{REF\,HP}$ as applied to summing junction 82. Thus, in the brief period of time following a transient, HP bypass valve 30 is rapidly opened to maintain the pressure $P_B$ substantially at its value prior to the transient. As the bypass valve 30 is opened, the valve demand signal indicative of the degree of valve opening (taken from the output of PID controller 86) is reflected through multiplier 74 to again stabilize the CFR signal which in turn produces a stable value in $P_{REF\,HP}$. The overall result is that $P_B$ and steam flow from the boiler are maintained substantially constant despite the abrupt change in turbine operation.

The LP bypass control loop, being directed to control the reheater pressure $P_{RH}$ in accord with the reference signal $P_{REF\,LP}$ derived from the CFR signal, is similarly stabilized since the CFR signal remains stable.

From the foregoing it will be recognized by those of ordinary skill in the art that, while a preferred embodiment of the invention has been described and while the best mode contemplated for carrying out the invention has also been described, certain modifications and adaptations may be made in the invention. For example, it will be apparent that equivalent control systems may be implemented which are either analog or digital in nature and which may use either electrical, hydraulic, fluidic, or pneumatic elements. It will be further recognized that certain portions of the control system may be implemented and carried out with digital or analog computing equipment. It is intended to claim all such modifications and adaptations which fall within the true spirit and scope of the present invention.

The invention claimed is:

1. An automatic control system for a steam turbine operating in conjunction with a boiler supplying steam under pressure, the turbine having a high-pressure (HP) section, at least one lower pressure (LP) section, a steam conduit interconnecting the HP section to the LP section through a steam reheater, at least one admission control valve for regulating the flow of steam to the HP section, and at least one intercept valve for regulating the flow of steam to the LP section, said control system comprising:

an HP bypass subsystem for passing steam around said high-pressure section, said bypass subsystem including at least one HP bypass valve for regulating steam flow in said HP bypass subsystem;

an LP bypass subsystem for passing steam around said lower pressure section, said bypass subsystem including at least one LP bypass valve for regulating steam flow in said LP bypass subsystem;

a load and speed control loop for operating said admission control valve to maintain preset turbine speed and load;

means providing a combined flow reference (CFR) signal indicative of total steam flow from the boiler;

an HP bypass control loop for operating said HP bypass valve to control boiler steam pressure in accord with a first reference signal; said first reference signal being determined from said CFR signal; and an LP bypass control loop for operating said LP bypass valve to control reheater steam pressure in accord with a second reference signal, said second reference signal being determined from said CFR signal.

2. The control system of claim 1 further including:

means providing an actual load demand (ALD) signal indicative of steam flow to said turbine to sustain said preset speed and load; and an intercept control loop for operating said intercept valve in response to said ALD signal.

3. The control system of claim 2 further including:

means providing an HP bypass valve demand signal indicative of degree of opening of said valve;

means providing an admission control valve position signal indicative of degree of opening of said admission control valve; and said CFR signal is formed from the sum of the products of (1) boiler pressure and said admission control valve position signal and (2) boiler pressure and said HP bypass valve demand signal.

4. The control system of claim 3 wherein:

said load and speed control loop includes means providing a turbine demand signal indicative of turbine load and speed demands; and said ALD signal is formed from the product of boiler pressure and said turbine demand signal.

5. The control system of claim 4 further comprising:

a reverse flow control subsystem including a turbine reverse flow valve; a turbine ventilator valve; and a switching means operative to cause said admission control valve to be closed and a reverse flow of steam through said HP section during starting and under reduced loading of said turbine, said turbine being driven solely by steam flow to said LP section during such starting and loading.

6. The control system of claim 4 or 5 further comprising:

flow limiting means disposed within said LP bypass control loop for automatically controlling said LP bypass valve to limit steam flow in said LP bypass subsystem to a maximum value.

7. The control system of claim 6 wherein said flow limiting means comprises a low value gate operative to select the lowest one of a plurality of input signals for controlling said LP bypass valve, said plurality of input signals including a signal in accord with said second reference signal and a signal in accord with a preselected flow limit L reduced by an amount proportional to the ratio of said ALD signal and a preselected constant K.

8. The control system of claim 7 wherein said preselected constant K represents the relative heat load of steam flow through said LP section as compared to the same amount of steam flow through said LP bypass subsystem.

9. The control system of claim 6 wherein said intercept control loop includes means for providing an intercept valve signal proportional to the product of said ALD signal and the inverse of a preslected value of reheater pressure for controlling the position of said intercept valve.

10. The control system of claim 6 wherein:

said HP bypass control loop includes an HP function generator for providing said first reference signal as a preselected function of said CFR signal, a transducer providing a boiler steam pressure signal, means for comparing said first reference signal with said boiler pressure signal to produce an HP error signal for controlling the positioning of said HP bypass valve to maintain equilibrium between said first reference signal and said boiler pressure signal;

said LP bypass control loop includes an LP function generator for providing said second reference signal as a preselected function of said CFR signal, a transducer providing a reheater steam pressure signal, means for comparing said second reference signal with said reheater pressure signal to produce an LP error signal for controlling the positioning of said LP bypass valve to maintain equilibrium between said second reference signal and said reheater pressure signal.

11. The control system of claim 10 wherein:

said HP function generator is adapted to provide said first reference signal at a first constant value for lower values of said CFL signal and to linearly increase said reference signal at a preselected slope to a second constant value at higher values of said CFR signal, said HP function generator having means for selecting said first constant value and means for selecting said second constant value; and said LP function generator is adapted to provide said second reference signal at a third constant value for lower values of CFR signal and to linearly increase said reference signal at a preselected slope at higher values of said CFR signal, said LP function generator having means to select said third constant value.

12. The control system of claim 11 wherein said HP bypass control loop includes means for limiting the time rate of change of said first reference signal so that the operating rate of said HP bypass valve is limited.

13. The control system of claim 12 wherein:

said HP bypass control loop includes means for producing an HP bypass valve position signal according to said HP error signal, the time integral value of said HP error signal, and the time derivative of said HP error signal; and said LP bypass control loop includes means for producing an LP bypass valve position signal according to said LP error signal, the time integral value of said LP error signal, and the time derivative of said LP error signal.

14. A reheat steam turbine for operation with a boiler supplying steam under pressure comprising:

a high-pressure (HP) turbine section, at least one lower-pressure (LP) turbine section, steam conduit means connecting the HP and LP sections, means reheating the steam between the HP and LP turbine sections, at least one control valve for controlling the flow of steam to the HP section, an intercept valve for controlling the flow of reheated steam to the LP section, an HP bypass for passing steam around the HP turbine section, an HP bypass valve for controlling the flow of steam in the HP bypass, an LP bypass for passing steam around the LP turbine section, an LP bypass valve for controlling the flow of steam in the LP bypass, a control loop for controlling the flow of steam to the turbine to maintain preset turbine speed and load and for supplying a control valve position signal and a turbine demand signal, means for supplying a signal representative of boiler steam pressure, means for generating a combined flow reference (CFR) signal representative of total boiler steam flow, means for generating an actual load demand (ALD) signal as the product of the boiler pressure signal and the turbine demand signal, an HP bypass control loop having means for generating a first preselected reference signal as a function of the CFR signal and means for positioning the HP bypass valve to maintain equilibrium between the boiler pressure signal and the first preselected reference signal, means supplying a signal representative of reheated steam pressure, an LP bypass control loop having means for generating a second preselected reference signal as a function of the CFR signal and means for positioning the LP bypass valve to maintain equilibrium between the reheated steam pressure signal and the second preselected reference signal, a steam flow limiting means disposed within said LP bypass control loop to limit the maximum steam flow in said LP bypass, and an intercept valve control loop having means for amplifying the ALD signal by a factor proportional to the inverse of reheated steam pressure to supply an amplified ALD signal and means to position the intercept valve in accord with the amplifier signal.

15. In combination with a reheat steam turbine operating in conjunction with a boiler supplying steam under pressure, the turbine of the type having a high-pressure (HP) section, at least one lower pressure (LP) section, a steam conduit interconnecting the HP section to the LP section, a steam conduit interconnecting the HP section to the LP section through a steam reheater, at least one admission control valve for regulating the flow of steam to the HP section, and an intercept valve for regulating the flow of steam to the LP section, a comprehensive control system comprising:

an HP bypass subsystem for passing steam around said high-pressure section, said bypass subsystem including an HP bypass valve for regulating steam flow therein and means providing an HP bypass valve position signal;

an LP bypass subsystem for passing steam around said lower pressure section, said bypass subsystem including an LP bypass valve for regulating steam flow therein;

a load and speed control loop for controlling the flow of steam to said turbine to maintain preset turbine speed and load, said control loop providing an admission control valve position signal;

means providing a combined flow reference (CFR) signal representing the sum of products of (1) boiler pressure and said admission control valve position signal and (2) boiler pressure and said HP bypass valve position signal;

an HP bypass control loop for operating said HP bypass valve to control boiler steam pressure in accord with a first reference signal determined from said CFR signal;

an LP bypass control loop for operating said LP bypass valve to control reheater steam pressure in accord with a second reference signal determined from said CFR signal.

16. The combination of claim 15 further including:

means providing a turbine demand signal indicative of turbine demand for steam to sustain preset load and speed;

multiplying means providing an actual load demand (ALD) signal representing the product of boiler steam pressure and said turbine demand signal; and an intercept valve control loop for operating the intercept valve in response to said ALD signal.

17. The combination of claim 16 wherein said intercept control loop includes means providing an intercept valve signal proportional to the product of said ALD signal and the inverse of a preselected value of reheater pressure for controlling the position of said intercept valve.

18. The combination of claim 17 wherein said LP bypass control loop further includes a flow limiting means to limit the maximum steam flow in said LP bypass subsystem.

* * * * *